US005803109A

United States Patent [19]

Rosen

[11] Patent Number: 5,803,109

[45] Date of Patent: Sep. 8, 1998

[54] SOLVENT AND AIR MIXING SYSTEM

[76] Inventor: Paul W. Rosen, 2201 78th Ave., Elmwood Park, Ill. 60707

[21] Appl. No.: 832,194

[22] Filed: Apr. 8, 1997

[51] Int. Cl.[6] ..... B08B 3/04; B08B 5/00; B08B 9/02

[52] U.S. Cl. ..... 137/15; 134/98.1; 134/102.2; 134/166 C; 137/240; 222/148; 239/112

[58] Field of Search ..... 137/3, 15, 240; 134/98.1, 102.2, 166 C, 168 C, 169 C; 222/148; 239/106, 112

[56] References Cited

U.S. PATENT DOCUMENTS

| | | | |
|---|---|---|---|
| 3,179,341 | 4/1965 | Plos et al. | 239/112 |
| 3,348,774 | 10/1967 | Wiggins | 239/112 |
| 3,373,762 | 3/1968 | Korchak | 137/240 |
| 3,403,695 | 10/1968 | Hopkins | 137/240 |
| 3,674,205 | 7/1972 | Kock | 137/240 |
| 4,033,481 | 7/1977 | Hicks et al. | 222/148 |
| 4,062,472 | 12/1977 | Taube | 222/148 |
| 4,487,367 | 12/1984 | Perry et al. | 239/112 |
| 4,549,676 | 10/1985 | Gerich | 222/148 |
| 4,746,063 | 5/1988 | Roberts | 239/112 |
| 4,881,563 | 11/1989 | Christian | 134/166 C |

*Primary Examiner*—George L. Walton

*Attorney, Agent, or Firm*—Thomas R. Vigil

[57] ABSTRACT

The solvent and air mixing system is used in an air solvent purging/cleaning system for an at least two liquid component mixing and applying system or a paint color changing system. The mixing and applying system includes at least two sources of liquid coupled to a mixer through respective control valves. An air solvent purging/cleaning system is provided including an air supply line and an air purge valve and a solvent supply line and a solvent purge valve coupled to the mixing and applying system or to a paint color changing system. A pneumatic valve control system is provided for controlling the supply of pressurized air to the air purge valve and for controlling the supply of solvent to the solvent purge valve. The solvent and air mixing system of the present invention includes a solvent and air mixing device having an air passageway coupled into the supply line for supplying pressurized air to the air purge valve. A solvent valve is coupled to the solvent supply line and to the solvent and air mixing device and communicates with a transverse passageway that opens onto, and is in communication with, the air passageway in the solvent and air mixing device. Control structures are coupled to the solvent valve for controlling operation of the solvent valve and for controlling the amount of solvent delivered from the solvent valve through the transverse passageway to the air passageway in the solvent and air mixing device. Preferably, part of the control structure is the pneumatic valve control system.

11 Claims, 3 Drawing Sheets

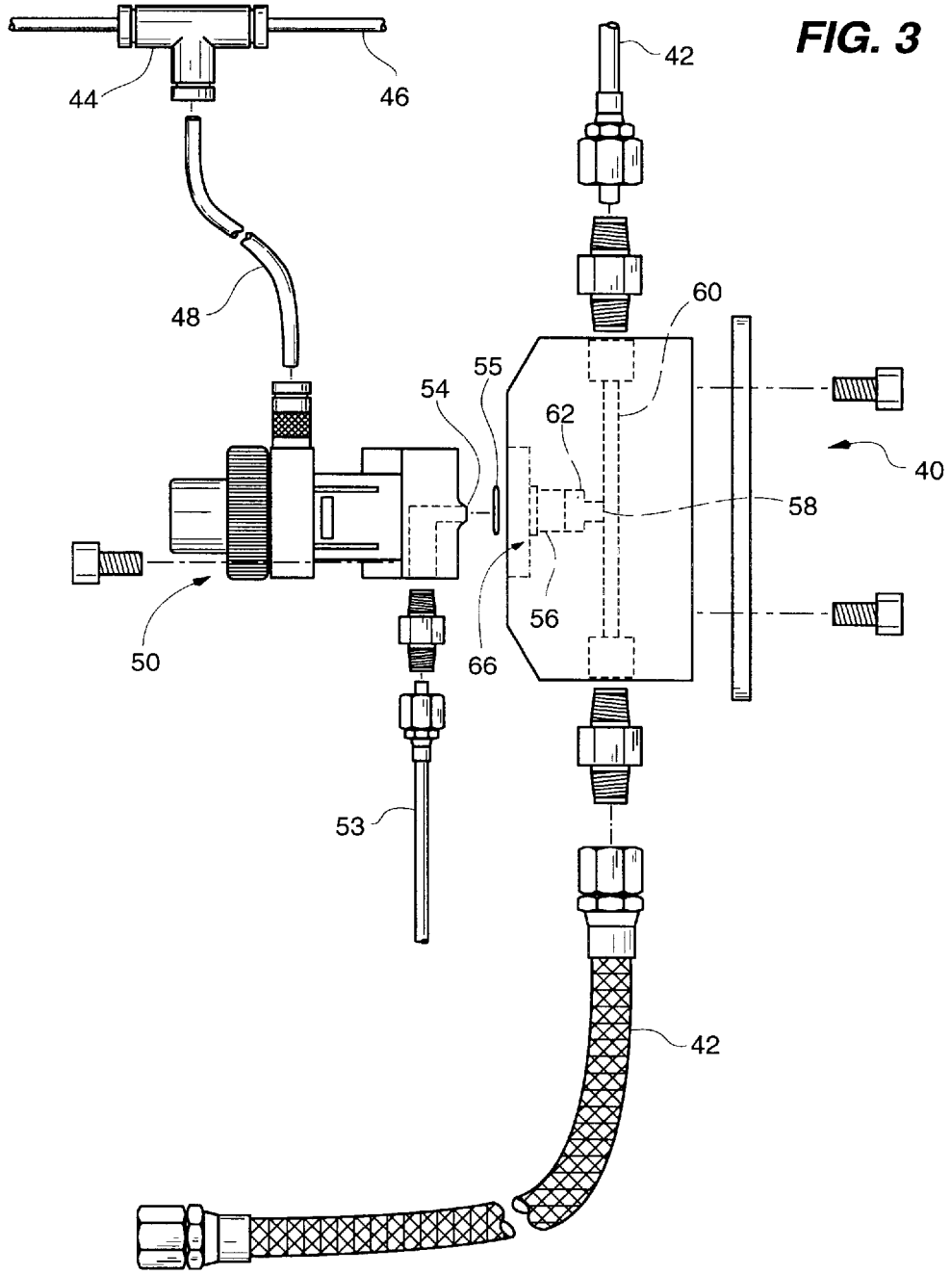
FIG. 3
FIG. 4
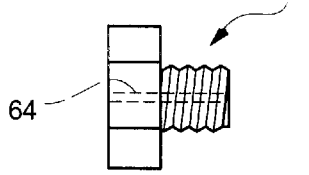

SOLVENT AND AIR MIXING SYSTEM

BACKGROUND OF THE INVENTION

1. Field of the Invention

The present invention relates to a liquid delivery line purging or cleaning system where at least two lines are brought to a mixer for combining or mixing of the liquids and subsequent application of the combined/mixed liquids. One line is purged or cleaned with solvent and the other line with air. The method and system of the present invention add a small amount of solvent to the air in the air cleaning line which is used to purge or clean the other line.

2. Description of the Related Art Including Information Disclosed Under 37 CFR §§1.97–1.99

Heretofore, in paint spray systems, where it is necessary to change the paint color available to the spray operator, a device called a color changer is employed. A color changer is a stack of valves, each valve supplied by an independent paint source such as a pump in a large container of a particular type of color of paint. Each valve supplies paint to a manifold common to all valves. By opening one valve of a particular color, the manifold then directs that paint to a conduit (hose) that supplies the paint applicator or application device, typically a paint spray gun, sometimes handheld, sometimes robotic, etc.

The type of applicator is irrelevant to the present invention. The purpose of the applicator is to start and stop the delivery of the paint and to atomize or otherwise dispense it. In applications where rapid changes from one color to another are necessary, color changers are employed.

This is the sequence of events during a color change using color changers:

1. The spray applicator is closed to stop fluid (paint) flow.

2. The spray applicator is positioned to direct the waste paint into a waste container.

3. The "opened" color valve is closed.

4. The spray applicator is activated to relieve fluid pressure from the color changer through the paint supply hose and through an outlet from the spray applicator.

5. An air color change valve (Air Purge Valve) on the color changer is opened, introducing compressed air to the color changer and paint hose to expel the waste paint through the hose and into the waste container. Regardless of the paint supply pressure, this air pressure typically is the maximum air supply pressure available in the plant, or typically never above approximately 120 psi. It is not unusual for this air supply pressure to be as low as 90 psi.

6. Once the compressed air evacuates the paint hose, the air purge valve is closed and a solvent color change valve (Solvent Purge Valve) is opened. The purpose of the solvent is to wash away any old paint that still clings to the walls of the color changer manifold, hoses, and spray applicator. Solvent pressure is typically set to be at the same pressure as the paint pressures that supply the paint valves. There are typically three groups of paint supply pressures, depending on the spray applicator used in the paint process:

A. Airspray—50 to 120 psi

B. Air Assisted Airless—700 to 1200 psi

C. Airless—1200 to 3000 psi

There are many variations of these categories depending on paint viscosity, etc., and a wide range of paint pressures relative to the air pressure are available to the air purge valve.

7. From this point, the solvent and air purge valves alternately open and close to provide an alternating solvent and air scrub that is more effective in a cleaning action than by solvent itself. The cycle may continue until the operator stops it, or it may be automatically controlled by a computer or other electro-mechanical device. When the operator does not open or vent the spray applicator, problems can occur. If the spray applicator is not opened before the color change process begins, or if the spray applicator is closed during the purge process, the purge process will accomplish nothing since the waste does not have anywhere to go.

The air purge valve will open to blow the paint hose out with 100 (plus or minus) psi. The paint hose, ballooned up from the paint pressure, and, given that the spray applicator is not activated to release this pressure, the old paint will move backwards through the air purge valve and into the compressed air supply lines. When the air pressure and the decreased fluid pressure balance, the backwards flow of paint will stop, and will then move forward again when the operator activates the spray applicator. This error is minimized by the use of check valves on all paint valves on the color changer, as well as on the solvent and air purge valves. There is, however, a small cavity in the air purge valve, between the valve seat and the face of the check valve. This cavity in the air purge valve holds compressed air which will be further compressed by the introduction into this cavity of the higher pressure paint when the air purge valve opens. The problem becomes more and more severe as paint pressures get higher. In fully automatic paint systems, such as robotic, where the spray gun trigger can be activated automatically prior to the color change sequencing, this is usually not an issue, though the robot has no way of knowing if the spray applicator dispensing tip is plugged, at which time there could still be a backflow issue because the pressurized paint has nowhere to go but backwards.

Once the air purge valve needle and seat are contaminated by paint, the air purge valve is subject to leaking. It will be a matter of time before the check valve becomes contaminated too. Any time after that, the compressed air supply may be subject to the same failure mode as described above. Note that the compressed air passing through the air purge valve and associated check valve does a poor job of cleaning, and is not intended to do any real cleaning at all, but only is intended to push old paint out of the way so that the cleaning solvent can do its job.

In addition, there are two component paints that, until both components are blended together (catalyzed), the components remain generally fluid. Once mixing is initiated, however, those paints will turn into a hard material over time. The only way to stop this hardening is to break down the material by flushing with solvent. Should this catalyzed material contaminate the air purge valve, it is a fact that the valve needle and seat will leak causing catalyzed paint to move into the compressed air supply.

It is possible to use solvent in all lines, "solvent only", to clean the paint passages, thereby eliminating the compressed air altogether. Some paint or liquid mixing systems actually do this. The chief disadvantage to doing this is that the solvent usage necessary to clean the system increases greatly, in volume, to accomplish the same level of cleaning as when using compressed air along with the solvent. However, due to solvent cost, waste solvent disposal costs, and Environmental Protection Agency limits on hazardous waste generation such as waste disposal and solvent emissions, this is not the desirable option.

The layout of the valving in some two component mixing systems is such that the solvent purge valve is located to clean the catalyst passageways, and the air purge valve is located to clean the resin passageways. Solvent and air come together in the same cavity that the resin and catalyst come together to mix. The reason that the solvent is installed on the catalyst side of the mixing system is that the catalyst is subject to degradation when exposed to air, or more specifically, the moisture (water, humidity) present in air. The catalyst side is, therefore, protected by the presence of solvent. In order to effect the most efficient cleaning procedure, the air, therefore, is introduced on the resin side. Protected by check valves, this layout is no different in operation than the paint color changing system described above.

Eventually the air purge valve needle and seat will become contaminated, be subject to leaking, and eventually be subject to allowing mixed paint and/or solvents to move backwards through the compressed air supply system.

SUMMARY OF THE INVENTION

According to the present invention there is provided a solvent and air mixing system for use in an air solvent purging/cleaning system for an at least two liquid component mixing and applying system or a paint color changing system. The mixing and applying system includes at least two sources of liquid coupled through respective control valves to a mixer. The air solvent purging/cleaning system includes an air supply line and an air purge valve and a solvent supply line and a solvent purge valve which are coupled to the mixing and applying system or to a paint color changing system. Structure is provided for supplying pressurized air to the air purge valve. Structure also is provided for supplying solvent to the solvent purge valve. A pneumatic control system is provided for controlling the operation of the air purge valve and the solvent purge valve. The solvent and air mixing system of the present invention includes a solvent and air mixing device having an air passageway coupled into the supply line for supplying pressurized air to the air purge valve. The solvent and air mixing system also includes a solvent line coupled to the solvent supply structure and a solvent valve connected to the solvent line, an outlet of the solvent valve being coupled to the solvent and air mixing device and communicating with a transverse passageway in the device that opens onto the air passageway in the solvent and air mixing device and that communicates with the air passageway. Control structures are associated with the solvent valve for controlling operation of the solvent valve and for controlling the amount of solvent delivered from the solvent valve through the transverse passageway to the air passageway in the solvent and air mixing device.

BRIEF DESCRIPTION OF THE DRAWINGS

FIG. 3 is an exploded side elevational view of the solvent and air mixing device shown in FIG. 2, but is shown with a low pressure solvent valve (0–300) psi solvent FIG. 4 is a plan view of a screw-in member with a throttling passageway therethrough which is mounted in the mixing device shown in FIG. 3.

DESCRIPTION OF THE PREFERRED EMBODIMENT(S)

Figure 1:
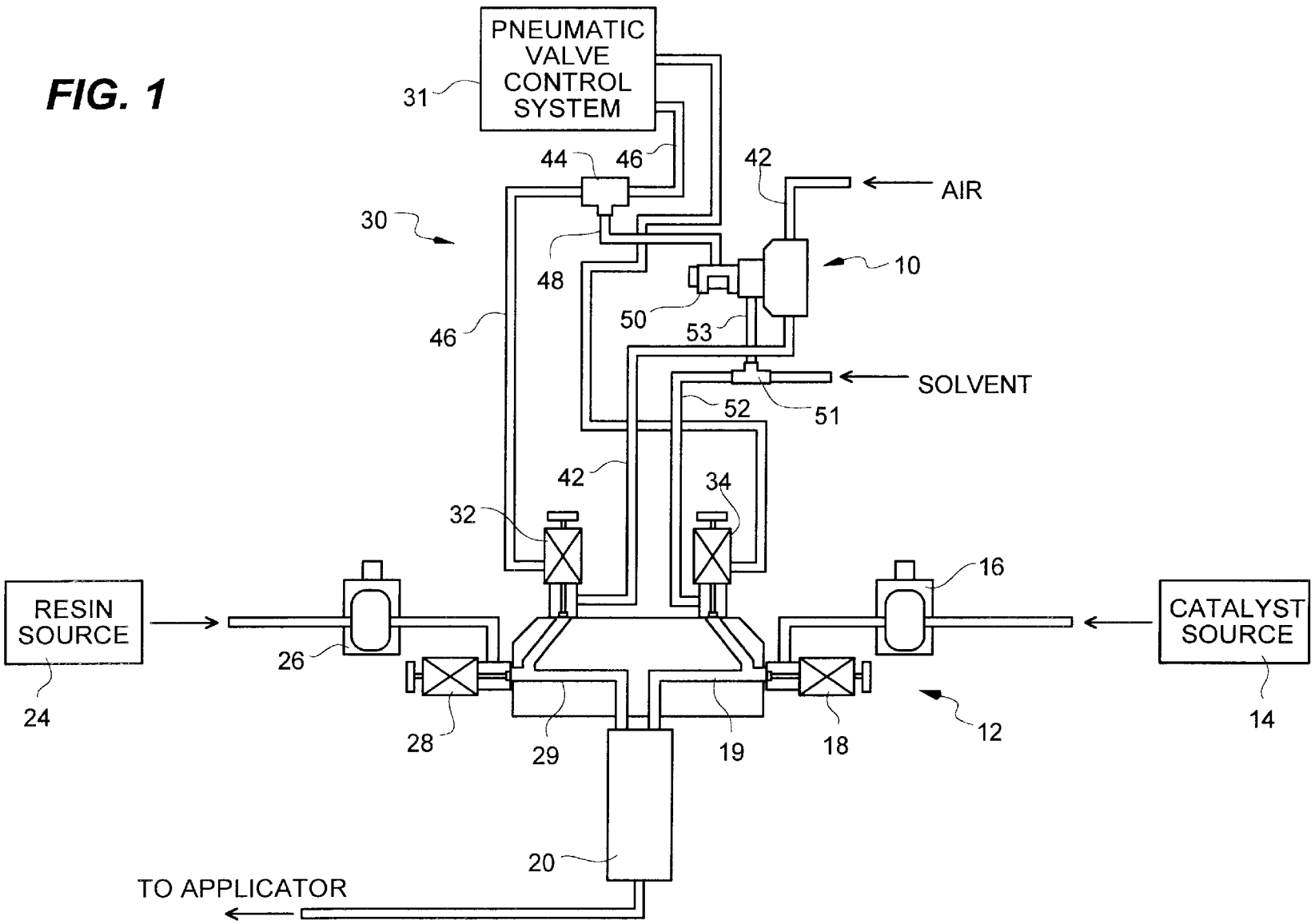
FIG. 1 is a block schematic diagram of the solvent and air mixing system of the present invention.
Figure 2:
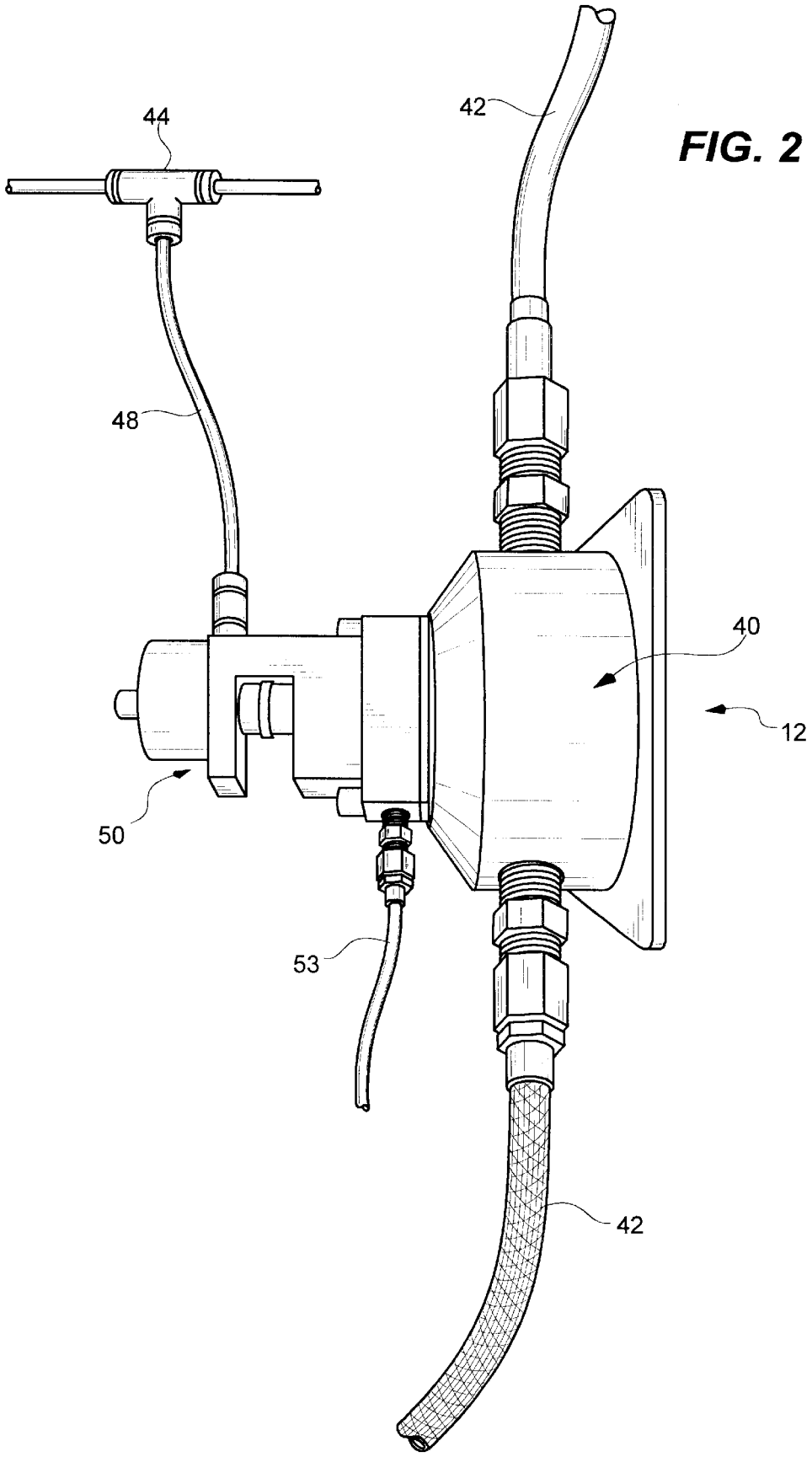
FIG. 2 is a perspective side elevational view of part of the mixing system shown in FIG. 1 and, in particular, showing a high pressure (300–2000 psi) solvent valve and a solvent and air mixing device.

Referring now to the drawings in greater detail, there is illustrated in FIG. 1 a solvent and air mixing system 10 constructed according to the teachings of the present invention. This system 10 is shown in conjunction with a two component mixing system 12 used to mix two liquid components. It will be understood that instead of a two component mixing system 12, the solvent and air mixing system 10 can be utilized with a paint color changing system (not shown).

As shown in FIG. 1, in the two component mixing system 12, a catalyst source 14 supplies catalyst through a meter 16 to a catalyst delivery valve 18 where delivery of catalyst through a delivery line 19 to a mixer 20 is controlled.

At the same time, resin from a resin source 24 is supplied through a meter 26 to a resin delivery valve 28 that controls the flow of resin through a delivery line 29 to the mixer 20.

The output from the mixer 20 is delivered to an applicator (not shown) such as a spray gun or robotic liquid delivery system.

Catalyst and resin mixing systems 12 on two or more paint mixing systems and paint color changing systems are typically of the type sold by Binks Manufacturing Company, DeVilbiss, Inc. or Graco, Inc.

During the use of the two component mixing system 12, the mixed liquid is delivered to an applicator such as a spray gun.

When it is time to clean or purge the lines, tubings, hoses and valves, e.g., lines 19 and 29, and valves 18 and 28 of the mixing system 12, an air solvent purge system 30 controlled by a pneumatic valve control system 31 is actuated to supply pressurized air to an air purge valve 32 of the system 30 to open same and to a solvent purge valve 34 of the system 30 to open same.

First, however, the catalyst delivery valve 18 and the resin delivery valve 28 are closed. Next, the operator opens the applicator, such as by squeezing a trigger of a spray gun. Then, the pneumatic valve control system 31 is operated to supply pressurized air, first to the air purge valve 32 for opening same to supply purging air to the resin lines, e.g. line 29, mixer 20 and outlet hose/applicator, with compressed air. Next, pressurized air is supplied by the control system 31 to the solvent purge valve 34 to open the solvent purge valve 34 to supply solvent to the catalyst lines, e.g., line 19, and to the mixer 20 and outlet hose/applicator.

According to the teachings of the present invention, a solvent and air mixing device 40 of the solvent and air mixing system 10 is provided and connected into a compressed air purge supply line 42 of the air solvent purge system 30 leading to the air purge valve 32, as shown. Further, a T connector 44 is connected into a pressurized air control line 46 from the pneumatic valve control system 31 for the air purge valve 32, as shown. A tubing or hose 48 from the T connector 44 is coupled to a solvent valve 50 mounted to the solvent and air mixing device 40. In this way, the same control pressure used to open the air purge valve 32 also opens the solvent valve 50.

The solvent valve 50 can be a conventional valve of the type normally used with the two component mixing system 12 or with a paint color mixing system.

As shown in FIG. 1, a T-connector 51 is provided in a solvent supply line 52 that supplies solvent to the solvent purge valve 34. A tubing or hose 53 extends from the T-connector 51 to the solvent valve 50 as shown.

As best shown in FIG. 3, an outlet 54 from the solvent valve 50 communicates through a filter 55 with a transverse passageway 56 in the solvent and air mixing device 40 that opens, at 58, onto an air through passageway 60 in the block shaped device 40 connected into the air purge supply line 42.

A solvent throttling member 62, in the form of a screw-in member 62 with an orifice 64 therethrough is provided in the transverse passageway 56. The screw-in member 62 is shown in larger detail in FIG. 4. Typically, the throttling passage 64 has a diameter of 0.040 inch, but can be a different size dependent upon orifice size needed to achieve a desired solvent to air ratio.

The filter 55 can be made of any known material and one material that provides satisfactory results is an expanded solvent resistant plastic mesh material. As shown in FIG. 3, the transverse passageway 56 is countersunk at 66 to provide a recess 66 for receiving the filter 55.

The filter 55 protects the orifice 64 from clogging with debris in the solvent supply.

In the use of the solvent and air mixing device 40, only a small amount of solvent is added to the pressurized air for the purpose of wetting areas in the resin delivery system or paint delivery system which may become contaminated with resin, catalyst or paint.

The solvent can be alcohol, water, MIBK, MEK, MAK, xylol, toluol, butyl cellosolve or other suitable solvent for cleaning paint lines and valves.

The ratio of air to solvent is between 50:1 to 150:1 by volume.

Also, it is to be understood that the solvent air mixing system 10 of the present invention is integrated into an existing air solvent purge system 30 controlled pneumatically by the pneumatic valve control system 31.

The solvent and air mixing device 40 is designed to mix solvent into the compressed air stream that supplies the air purge valve 32. The solvent is supplied to the solvent and air mixing device 40 at the same supply pressure as is used on the solvent supplied to the solvent purge valve 34. This solvent pressure should be set at the highest paint pressure supplied to the mixing chamber in the mixer 20, or slightly higher (+20 PSI), to assure that there can be no backwards movement of the fluid column. The solvent valve 50 on the solvent and air mixing device 40 opens and closes simultaneously with the opening and closing of the air purge valve 32.

Should the spray applicator not be opened to allow the paint hose to depressurize when the purge cycle is initiated, solvent will be dispensed by the solvent valve 50 of the solvent and air mixing device 40 into the air purge line, 42 and 60, to bring the air passage up to the solvent pressure which, if the system 30 is set up properly, will balance the paint pressure with the air/solvent pressures in the air passageways, preventing backflow of paint through the compressed air system, line 42.

A check valve on the air inlet to the solvent and air mixing device 40 closes when the pressure in the air passageway 60 becomes higher, due to solvent introduction, than the applied air pressure. There is nothing else that can be done, if the operator does not trigger the spray applicator, than to add some solvent to the air passage to dilute any mixed paint that did move backwards. The solvent and air mixing system 10 does this automatically. As the solvent and air/paint column moves forward during the first portion of the purge cycle, the solvent and air mixing device 40 returns automatically to its metering function that allows a large percentage of air as opposed to solvent, to flow, and allows the air to resume its scrubbing action.

The benefits of the solvent and air mixing device 40 in the solvent and air mixing system 12 are as follows:

1. Provides controlled volume of solvent in an air purge stream to clean fluid passages in paint, ink, or other fluid handling devices that were previously cleaned by air only.

2. Enhances the cleaning of paint systems where a solvent/air chop is used during a purge cycle.

3. Works automatically with the air purge valve and needs no additional external controls.

4. No variable orifice exists that can be manipulated or closed by unauthorized personnel to cancel proper function. The screw-in member 62 with the fixed orifice 64 is replaceable and optional orifice sizes can be chosen to control maximum solvent amounts dispensed into the air stream. The filter 54 protects the orifice 66 from clogging.

5. The solvent valve 50 on the solvent and air mixing device 40 provides a positive stop to prevent unintentional dispensing of solvent into the mixed material stream. Solvent pressure is not applied at all times to the air purge valve.

6. Provides additional check valve in the system 30 to assure no material backflow.

7. Provides automatic pressure compensation in the air purge supply line, for a fluid column that may be at a higher pressure than the compressed air column.

8. In two component paint systems (regardless of paint pressures) that have color changers on the resin (A) side, along with a gear meter to measure the resin flow, it was previously impossible to use air in the purge cycle because air pushing through the meter would burn up the gears and meter housing. (Meters cost $3,500.00 to $4,000.00). It would greatly enhance the speed and efficiency of the purge cycle if air could be used in the resin (A) color changer. In this application, the solvent and air mixing device 40 would be set to supply enough solvent to cool the gears, and thus allow for use of a solvent/air chop into the color change cycle.

From the foregoing description, it will be apparent that the solvent and air mixing system 10 including the solvent and air mixing device 40 and the solvent valve 50 of the present invention has a number of advantages, some of which have been described above and others of which are inherent in the invention. Also it will be understood that modifications can be made to the solvent and air mixing system 10 described above without departing from the teachings of the present invention. Accordingly, the scope of the invention is only to be limited as necessitated by the accompanying claims.

I claim:

1. A solvent and air mixing system for use in an air solvent purging/cleaning system for an at least two liquid component mixing and applying system or a paint color changing system; the mixing and applying system including at least two sources of liquid coupled to a mixer through respective control valves; said air solvent purging/cleaning system including an air supply line and an air purge valve and a solvent supply line and a solvent purge valve; means for supplying pressurized air to the air purge valve; means for supplying solvent to the solvent purge valve; and a pneumatic control system for controlling the operation of the air solvent purge system including control of the air purge valve and the solvent purge valve; said solvent and air mixing system including a solvent and air mixing device having an air passageway coupled into the supply line for supplying pressurized air to the air purge valve; a solvent valve for controlling delivery of solvent to said solvent and air mixing device said solvent valve having an inlet coupled to the means for supplying solvent and an outlet coupled to said solvent and air mixing device air and communicating with a transverse passageway in the solvent and air mixing device that opens onto said air passageway in said solvent and air mixing device; means coupled to said solvent valve for controlling operation of said solvent valve; and means for controlling the amount of solvent delivered from said solvent valve through said transverse passageway to said air passage in said solvent and air mixing device.

2. The solvent and air mixing system of claim 1 wherein said pneumatic valve control means includes a control supply line to said air purge valve and said means for controlling said solvent valve includes a coupling to said control supply line whereby said solvent valve is actuated every time said air purge valve is actuated.

3. The solvent and air mixing system of claim 1 wherein said solvent supply line includes a coupling and a line extends from said coupling to said solvent valve for supplying solvent to said solvent valve.

4. The solvent and air mixing system of claim 1 wherein said means for controlling the delivery of solvent to said air passageway in said solvent and air mixing device includes a liquid throttling member.

5. The solvent and air mixing system of claim 1 wherein said means for controlling the delivery of solvent to said air passageway in said solvent and air mixing device includes a screw-in member having an orifice therethrough with a predetermined diameter, said screw-in marker being mounted in said transverse passageway whereby said screw-in member can be removed from said transverse passageway in said solvent and air mixing device for changing the orifice by inserting another screw-in marker with a different orifice diameter.

6. The solvent and air mixing system of claim 5 wherein said orifice diameter is approximately 0.40 inch.

7. The solvent and air mixing system of claim 1 wherein said transverse passageway has a recess for receiving a filter between said solvent valve and a throttling orifice in said transverse passageway.

8. The solvent and air mixing system of claim 7 wherein said filter is made of a solvent resistant material.

9. A method for cleaning one side of a two liquid component mixing system or a paint color changing system with an air and solvent purging/cleaning system, said method including the steps of: (a) supplying purging air through an air purge line to at least one valve and line for cleaning same; (b) adding a small amount of solvent to said air purge line and (c) cleaning the lines and valves for the one liquid component with air combined with a small amount of solvent.

10. The method of claim 9 wherein the solvent to air mixture is in a ratio between approximately 1:50, solvent to air, and approximately 1:150, solvent to air, by volume.

11. The method of claim 9 wherein said solvent is selected from the class consisting of alcohol, water, MIBK, MEK, MAK, xylol, toluol, butyl cellosolve, or combinations thereof.

* * * * *